US005201419A

United States Patent [19]

Hayes

[11] Patent Number: 5,201,419

[45] Date of Patent: Apr. 13, 1993

[54] CHAIN CONTAINER

[75] Inventor: Richard D. Hayes, Edwardsville, Ill.

[73] Assignee: Laclede Chain Manufacturing Company, St. Louis, Mo.

[21] Appl. No.: 839,938

[22] Filed: Feb. 21, 1992

[51] Int. Cl.[5] ..... B65D 85/62; B65D 85/66

[52] U.S. Cl. ..... 206/409; 206/389; 206/508; 206/509; 206/511; 206/525

[58] Field of Search ..... 206/389, 407, 408, 409, 206/511, 525

[56] References Cited

U.S. PATENT DOCUMENTS

| | | | |
|---|---|---|---|
| 1,431,352 | 10/1922 | Abbott | 206/409 |
| 1,951,543 | 3/1934 | Bruns et al. | 206/408 |
| 3,556,293 | 1/1971 | Schlueter . | |
| 5,103,977 | 4/1992 | Douglas | 206/408 |

FOREIGN PATENT DOCUMENTS

| | | | |
|---|---|---|---|
| 686523 | 3/1965 | Italy | 206/511 |

OTHER PUBLICATIONS

Peerless Chain Company Advertisement Publicly introduced at the National Hardware Show, Aug., 1991 at McCormick Place, Chicago, Ill.

*Primary Examiner*—William I. Price
*Attorney, Agent, or Firm*—Kalish & Gilster

[57] ABSTRACT

A unitary container for storing and dispensing chain includes a box-shaped chain holder portion having a continuous top edge adapted for interlocking receipt of a selectively removable lid, a bottom wall, and first and second pairs of opposed side walls which extend between and connect the open top edge and the bottom wall. The container also includes a lid adapted for selectively easily removable attachment to the continuous open top edge of the chain holder position. The lid has an integral chain dispensing and retaining portion to permit access to and removal from the chain holder portion through the lid of desired lengths of chain, and is formed so as to deter chain removed from the chain holder from unintentionally slipping thereinto.

21 Claims, 6 Drawing Sheets

CHAIN CONTAINER

BACKGROUND OF THE INVENTION

1. Field of Invention

The present invention relates in general to storage and dispensing containers for continuous material and, more particularly, to a recyclable lidded container especially for use with a chain merchandising apparatus for storage and dispensing of continuous lengths of chain.

2. Description of the Prior Art

Ordinarily, retail establishments which sell chain, cable, rope and the like, encounter a number of difficulties therewith. Because of the wide range of consumer needs a large variety of such items in various sizes and types is required to adequately satisfy the market. And thus, a substantial amount of in-store space must be designated for this purpose. In examining and selecting a chain or other continuous material for purchase, the customer often unwinds or otherwise unravels lengths of a number of different types of the material. Ultimately, one may be selected for purchase and the others left for store personnel to replace properly. In the usual situation, it is only a matter of a short period of time before the display site becomes untidy, and unsightly, if not dangerous, because of the jumble of merchandise which has been left behind. Often, a significant risk of in store falls or trips is presented by loose chain remaining on the floor.

Thus, there is a long-standing need in the market place for an apparatus for chain merchandising which allows the various types of chain, cable and other continuous material marketed alongside to be presented in a relatively neat fashion, preferably using a minimum amount of floor space.

Previous approaches have been to provide chain in conventional five gallon buckets or on reels, either of which may be mounted on an open rack to somewhat reduce the amount of horizontal space required to be used by the store for the chain display. Such displays still require a large amount of floor space and tend to become cluttered and generally untidy with lengths of loose chain.

Another inexpensive chain dispenser is seen in U.S. Pat. No. 3,556,293, issued to Schlueter, which patent describes a cubic cardboard box having completely flat parallel opposed sides and a plastic plate fixed to one wall of the box by staples, gluing or other fastening means after filling the box with loose chain. The plastic plate of the Schlueter chain dispenser has a small central opening and a pair of slots which intersect at the central opening in an X formation to define paired opposed flexible groping fingers through which to remove the chain from the box. Being of cardboard, the box of Schlueter is inexpensive, yet has a very limited life as it is subject to collapse upon stacking or shipping and will become mildewed upon exposure to moisture. Also, the Schlueter apparatus is not easily reusable, unless the plate is detached from its fixed position on the easily destroyed cardboard box.

A new approach to retail chain marketing has been developed and is described and claimed in a copending United States Patent Application by the inventor herein and includes a chain merchandising apparatus which is presently being successfully marketed. That chain merchandising apparatus includes, inter alia, forwardly slanted shelves preferably having indentations or grooves which run front to back on each shelf. The new chain storage and dispensing container addresses the problems seen in the prior art and is designed especially, although not exclusively, for cooperating use with the aforesaid chain merchandising apparatus.

Accordingly, it is an object of the present invention to provide a container for storing and dispensing continuous lengths of chain and other elongated materials in a manner which makes more efficient use of display space than previously known, the container being formed from recyclable material and being capable of being recycled itself and adapted with a snap fit lid of the same material.

It is another object of the present invention to provide a container of the character stated which is extremely strong and adapted for stacking of multiple filled containers for shipping and storage without crushing or accidental opening thereof, yet may be selectively opened by hand without the use of tools.

It is a further object of the present invention to provide a container of the character stated which may be quickly and inexpensively mass produced in various sizes and colors by known blow molding methods, which container is capable of being reused indefinitely, and which container is especially well suited for use in combination with a chain merchandising unit having forward sloping grooved shelves.

It is yet a further object of the present invention to provide a container of the character stated which is waterproof so as to be long lasting and to protect the chain or other material therein from rusting and yet is adapted so as to be safe from risk of drowning which would otherwise be presented to infants and small pets from such containers which have been emptied of chain and allowed to collect water therein.

It is still a further object of the present invention to provide a container of the character stated which is light weight when empty and provided with a lid portion which is optionally adapted to permit facile withdrawal of the chain from the associated container while preventing inadvertent return of the chain thereinto.

Accordingly, in furtherance of the above objects, the present invention is, briefly, a unitary container for storing and dispensing continuous lengths of chain. The container includes a box-shaped chain holder portion having a continuous open top edge adapted for receipt of a selectively removable lid, a bottom wall, and first and second pairs of opposed side walls which extend between and connect the open top edge and the bottom wall. A lid is adapted for secure yet selectively easily removable attachment to the continuous open top edge of the chain holder portion and has an integral chain dispensing and retaining structure for permitting access to and removal from the chain holder portion through the lid of desired lengths of chain. The chain dispensing and retaining structure is formed so as to permit effecting snug engagement of an adjacent portion of chain therewith for preventing chain removed from the chain holder portion from unintentionally returning completely thereinto.

The container of the present invention also includes, briefly, an integral chain dispensing and retaining structure which is located centrally on the lid and is composed of an integral punched portion of the lid having a generally keyhole shape with a central aperture therethrough and at least one pointed extension thereon. The punched portion is connected along the periphery thereof to the lid by integral connector portions to thereby provide integral chain dispensing and retaining structure of a form which may be modified from the central aperture to a keyhole shape by fast simple, removal of the integral punched portion of the lid and to provide an adaptation for dispensing the chain while permitting effecting snug engagement of an adjacent portion of chain therewith for preventing chain removed from the chain holder portion from unintentionally returning completely thereinto.

Other objects will be in part apparent and in part pointed out hereinbelow.

DESCRIPTION OF PRACTICAL EMBODIMENTS

Figure 1:
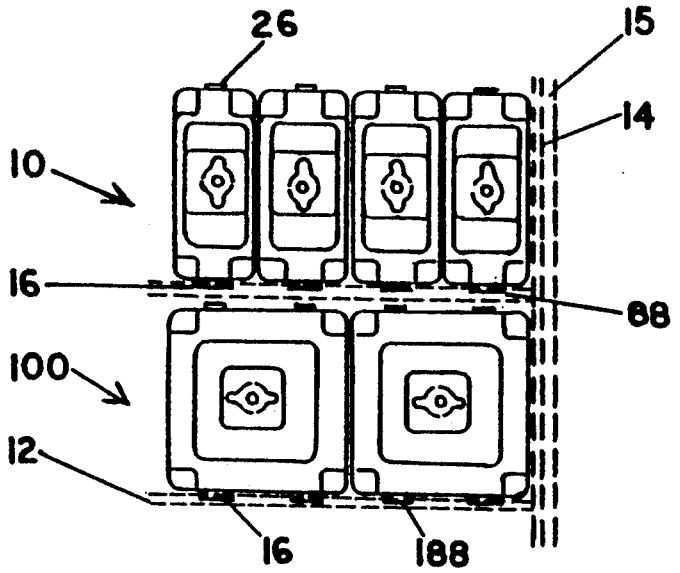
FIG. 1 is a fragmentary schematic front view of a shelving unit, in phantom, showing two embodiments of a chain storage and dispensing container constructed in accordance with and embodying the present invention.

With reference to the drawings, FIG. 1 schematically illustrates a first embodiment of the new chain storage and dispensing container, generally designated 10, and a second embodiment of the new chain storage and dispensing container, generally designated 100, both constructed in accordance with and embodying the present invention and displayed on shelves 12 (shown in phantom), which are mounted on supports 14 of a chain merchandising unit 15 for use in retail stores. Each shelf 12 is provided with slots 16 which pass from front to back in parallel spaced relation to each other and which function as optional guide grooves for containers 10, 100 as described further herein.

Illustrated more clearly in FIGS. 2 through 7 is first embodiment 10 of the new chain storing and dispensing container. It is understood that each container 10 may be used equally well as a unitary device for shipping, storage and dispensing of chain or other heavy elongated materials such as aircraft cable or wire rope which is preferably mounted in coiled form within container 10. For simplicity of discussion however, the term "chain" will often be used alone and presumed to include other such materials.

Container 10 is preferably formed as a generally rectangular box by blow molding either as two pieces, or Preferably as one piece which is later separated into two, a one-piece lid portion and a box portion, both described hereafter. Container 10 preferably consists of high density polyethylene which has been formed of approximately 65% recycled materials and may be again recycled or refilled and reused indefinitely. The especially preferred material is classified by industry recycling standards as a No. 2 material and is formed so as to be 0.080 inches thick. However, other moldable plastics and other thicknesses will function adequately.

Figure 2:
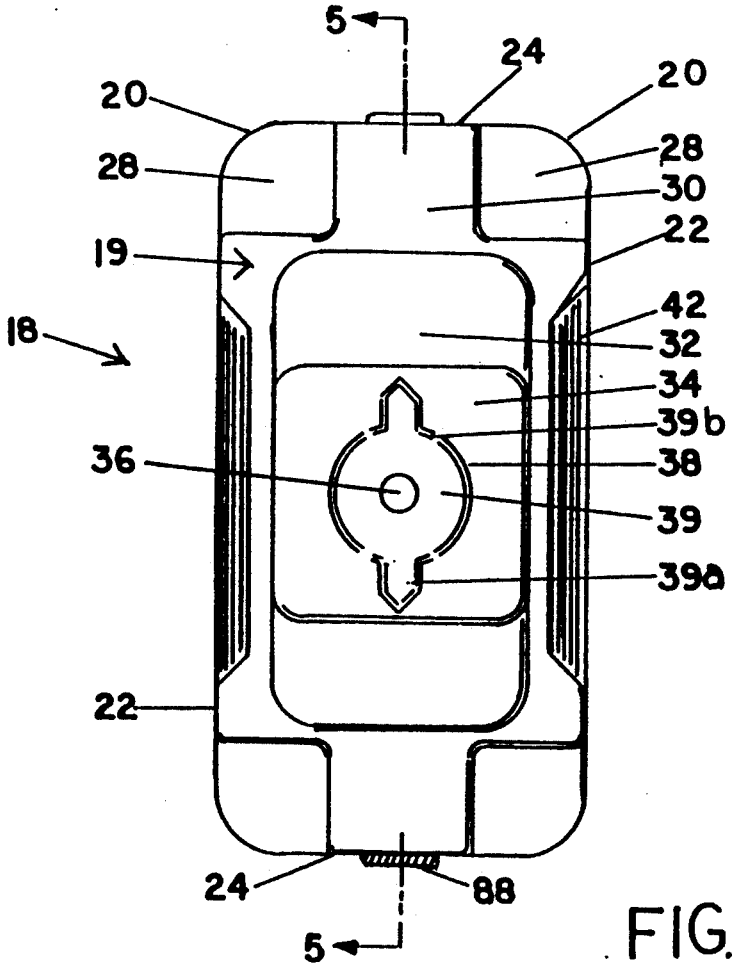
FIG. 2 is a front elevational view of a first embodiment of the chain storage and dispensing container constructed in accordance and embodying the present invention.

As shown in FIG. 2, container 10 includes a snugly fitted lid 18 which is substantially rectangular and provided with rounded corners 20 at which corners 20 opposed, parallel longitudinal edges 22 intersect opposed parallel transverse edges 24. Edges 22, 24 define a front or face 19 of lid 18 which as shown is constructed in plateaued multiplanar fashion having various parallel levels. Rounded corners 20 make up the outer edge of four identical substantially square flat areas 28 which all lie in one plane of face 19 and serve as foot rests for a superior container 10 when in upright stacked relationship for shipping or storage.

Flat corner areas 28 are interconnected by an irregularly shaped flat area 30 which is formed parallel to and outward from the plane which flat areas 28 all share. Formed outwardly from irregular planar area 30 and longitudinally in relation to lid 18 is a rectangular area 32 which lies in a third plane, parallel to and outwardly of irregular area 30.

Centrally on rectangular area 32 and sharing equal opposed portions of the longitudinal sides thereof is a substantially square area 34 which lies in a fourth plane of lid face 19, outwardly of rectangular area 32. Square area 34 is centrally penetrated by an aperture 36 which is initially preferably substantially circular and approximately one-half inch in diameter. Aperture 36 is surrounded by a line of weakness 38 which preferably defines a keyhole-shaped portion 39 more-or-less as a donut having pointed opposed lateral extensions 39*a* thereon and which is connected to surrounding square area 34 by spaced formed connectors 39*b*.

Figure 5:
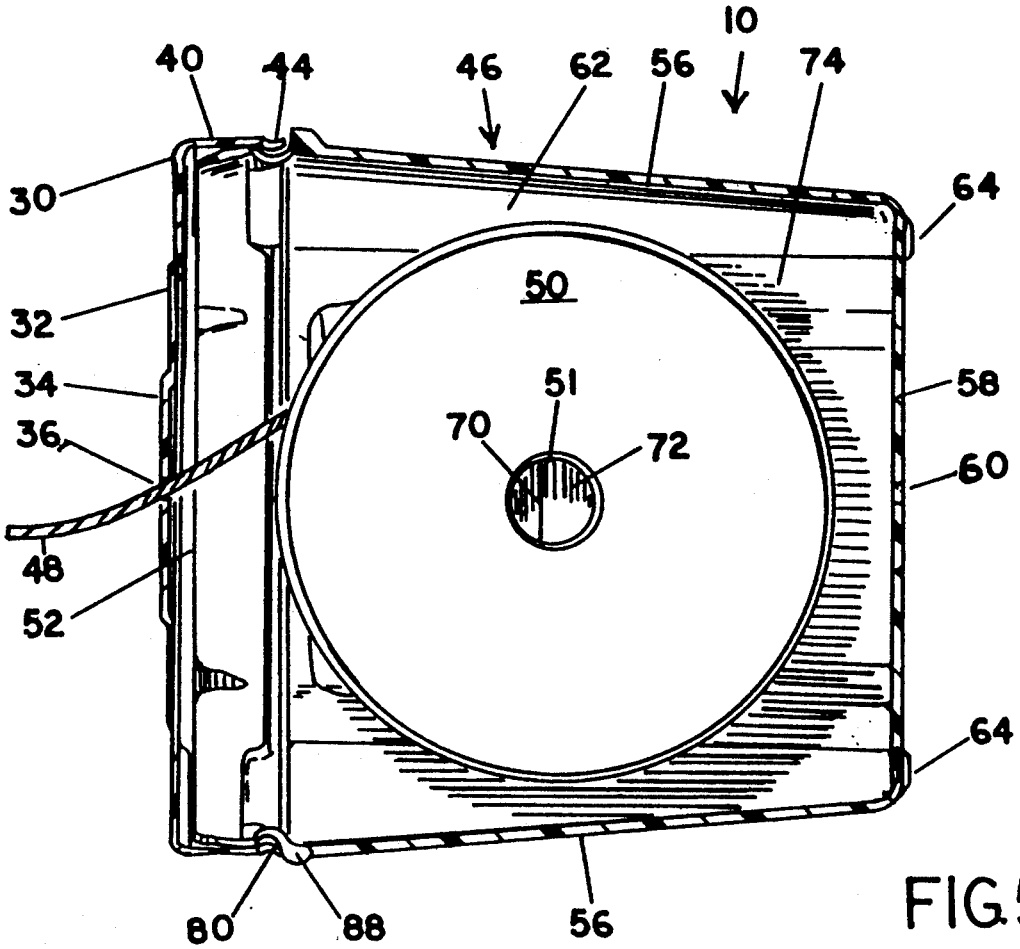
FIG. 5 is a vertical sectional view taken on line 5—5 of FIG. 2 and further illustrating a non-sectional coil of cable mounted in the container
Figure 6:
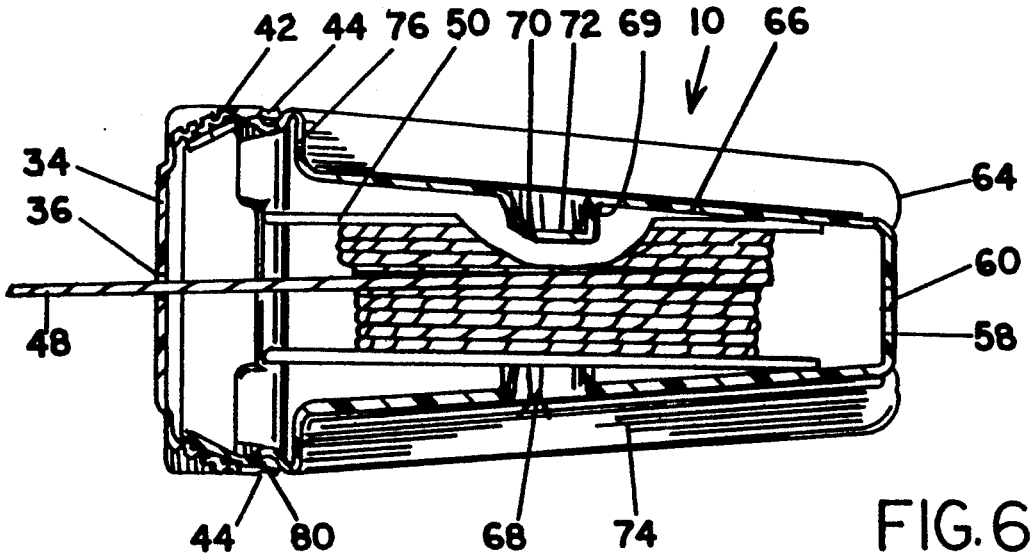
FIG. 6 is a horizontal sectional view taken on line 6—6 of FIG. 3 and further showing a non-sectional, partially broken away reel of cable mounted in the container.

Container 10 may be used as illustrated in FIGS. 5 and 6, having cable 48 threaded for dispensing outward through aperture 36. However, if container 10 is used to store and dispense, for example, small chain, it may be necessary or desired to pop out lid portion 39 so that the chain links can be engaged by the pointed extension areas which remain after removal of extensions 39*a* from lid 18.

Figure 3:
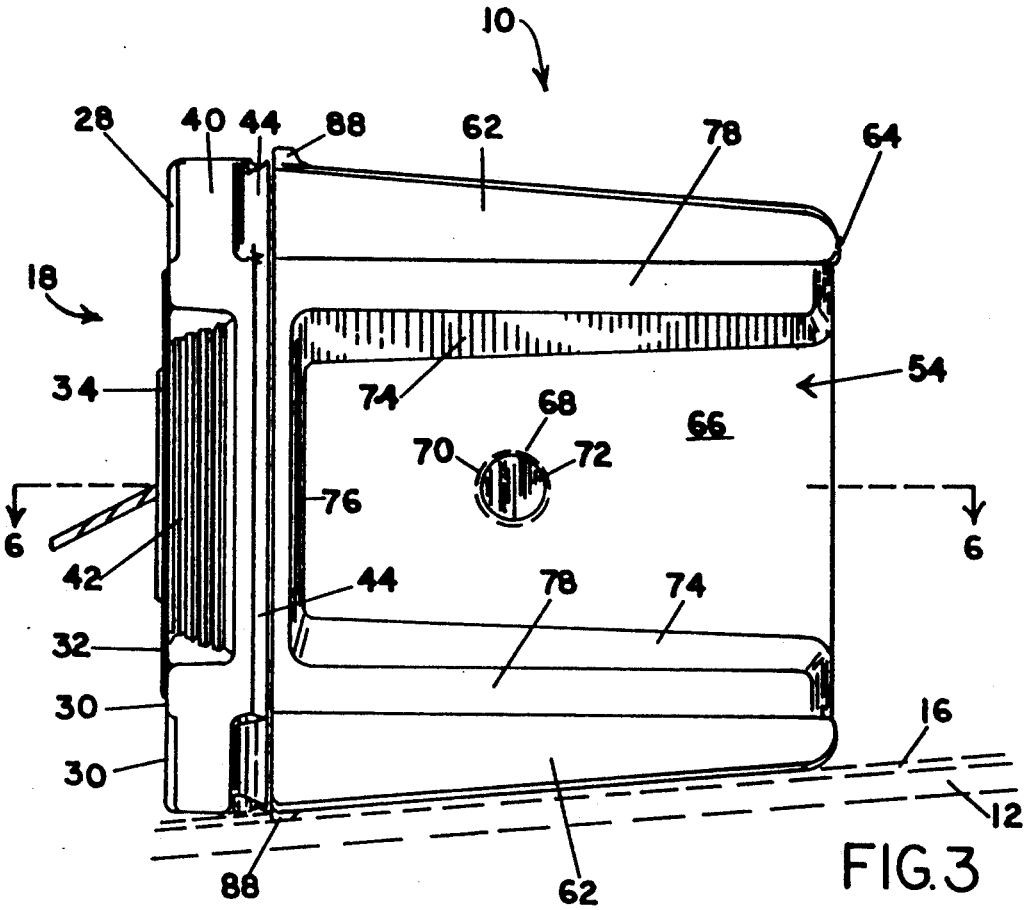
FIG. 3 is a side elevational view of the container of FIG. 2.

FIG. 3 illustrates a side view of lid 18 with container 10 positioned on shelf 12 in reclined position for dispensing its contents, and showing a flange 40 which extends continuously along edges 22, 24 and around smooth, rounded corners 20 perpendicularly in relation to the planes forming front or face 19 of lid 18. Centrally along edges 22 from irregular planar area 30 to flange 40 are several parallel ridges 42 preferably formed in outwardly and downwardly stepped fashion to enhance gripping of lid 18. Flange 40 terminates in a continuous open lip or edge 44 which is indented at least partially along the length thereof. As is readily apparent from the figures, lid 18 is formed such that halves taken along a central longitudinal axis or a central transverse axis are mirror images of each other, so that rotation of lid 18 by 180 degrees within a plane of lid face 19 will not affect either appearance nor function of lid 18.

Figure 4:
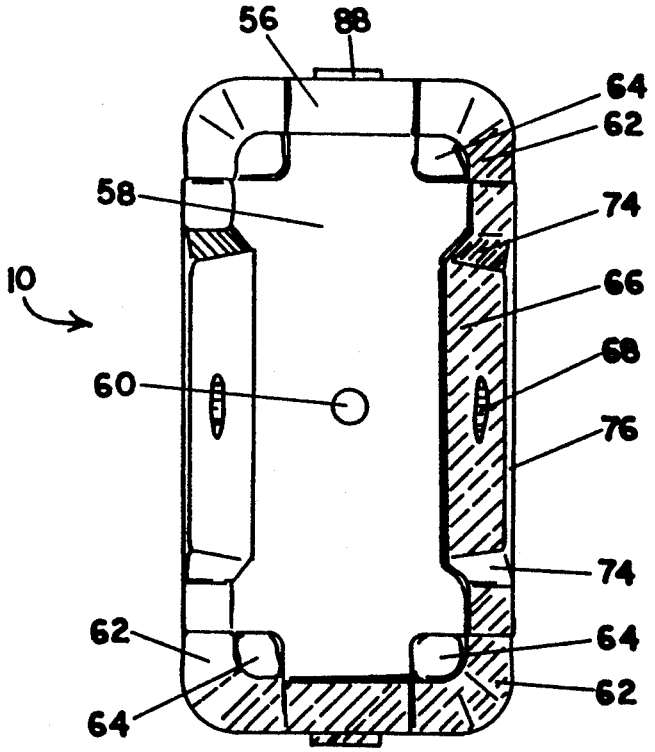
FIG. 4 is a back elevational view of the container of FIG. 2.

Connected in normal use by interlocking fit to lid 18, as described more fully hereafter, is a rectangular box or holder portion 46 for containment therein of chain, cable and the like, such as, for example, cable 48 which is optionally wound on reel 50. Box 46 generally extends from continuous open edge 52 along perpendicular pairs of opposed side walls 54, 56 to bottom or rear wall 58 which is centrally penetrated by a through hole 60 (FIG. 4). Through hole 60 is provided for the specific purpose of preventing water from collecting in box 46 when upright; thus deterring rusting of items stored in container 10, as well as avoiding drowning of small children and pets in liquid which could otherwise be permitted to stand in an empty box 46.

Opposed side walls 54 are identical to each other and extend between and intersect opposed side walls 56 (which are also identical to each other) along corners 62 for the entire depth of box 46 and terminate at bottom wall 58 thereof in rounded feet 64 for support of box 10 in an upright position for storage or shipping. When multiple containers 10 are stored in upright stacked relationship feet 64 of a superior container 10 will rest on corresponding flat corner areas 28 of a container 10 located therebeneath.

Desirably, walls 54, 58 all slope gently inwardly at a slight draft angle, for example of approximately 5°, as they extend from edge 52 bottom wall 58, so as to enhance stacking and handling and to permit lid face 19 to be positioned vertically when container 10 is in reclined dispensing position on a gently angled shelf 12. Container 10 of course may also be displayed on flat, horizontal shelves, as in the usual retail store. In that case, the angle of walls 56 causes face 19 of lid 18 to be presented slightly upward, which latter enhances visibility of face 19 when container 10 is on low shelves, of shoulder height or less.

With reference to FIGS. 3 and 5 through 7, each side wall 54 has a substantially rectangular flat central portion 66 in longitudinal relationship to wall 54 and provided approximately centrally thereon with an indented hub 68 having a preferably straight-sided annular wall 69 extending into box 54 and which intersects and continues into an angled flat forward area 70 and a rear flat area 72, which latter is substantially parallel to flat central portion 66 of wall 54.

FIG. 6 shows that angled portion 70 of indented hub 68 is formed so as to slant from a position substantially adjacent the inside of side walls 54 toward a central longitudinal axis of box 46 so as to facilitate slideable insertion of reel 50 into box 46 and onto hub 68. However, flat portions 72 of opposed hubs 68 extend rearwardly parallel to each other, toward bottom wall 58 from angled portion 70 and stop abruptly in corresponding straight-sided annular walls 69 so as to catch a hub 51 of reel 50 and prevent inadvertent removal thereof from box 46. Alternatively, hubs 68 can be omitted and reel 50 placed free and unattached in container 10. However, the latter arrangement cannot be expected to function as smoothly and some drag and tangling may occur.

Flat areas 66 of container side walls 54 are each longitudinally flanked by two outwardly angled strip-shaped wall areas 74. Strips 74 extend substantially parallel to each other from points approximately adjacent rear wall 58 in the direction of box edge 52, but terminate at and intersect opposed ends of a ledge 76 which projects transversely and perpendicularly in relation to flat wall portion 66, parallel to edge 22 of lid 18 so as to be useful as a handle in movement of container 10. Outwardly angled strips 74 and ledge 76 terminate outwardly in a flat wall portion 78 which is generally shaped as an inverted U and is planarly parallel to flat area 66 of side wall 54.

Figure 7:
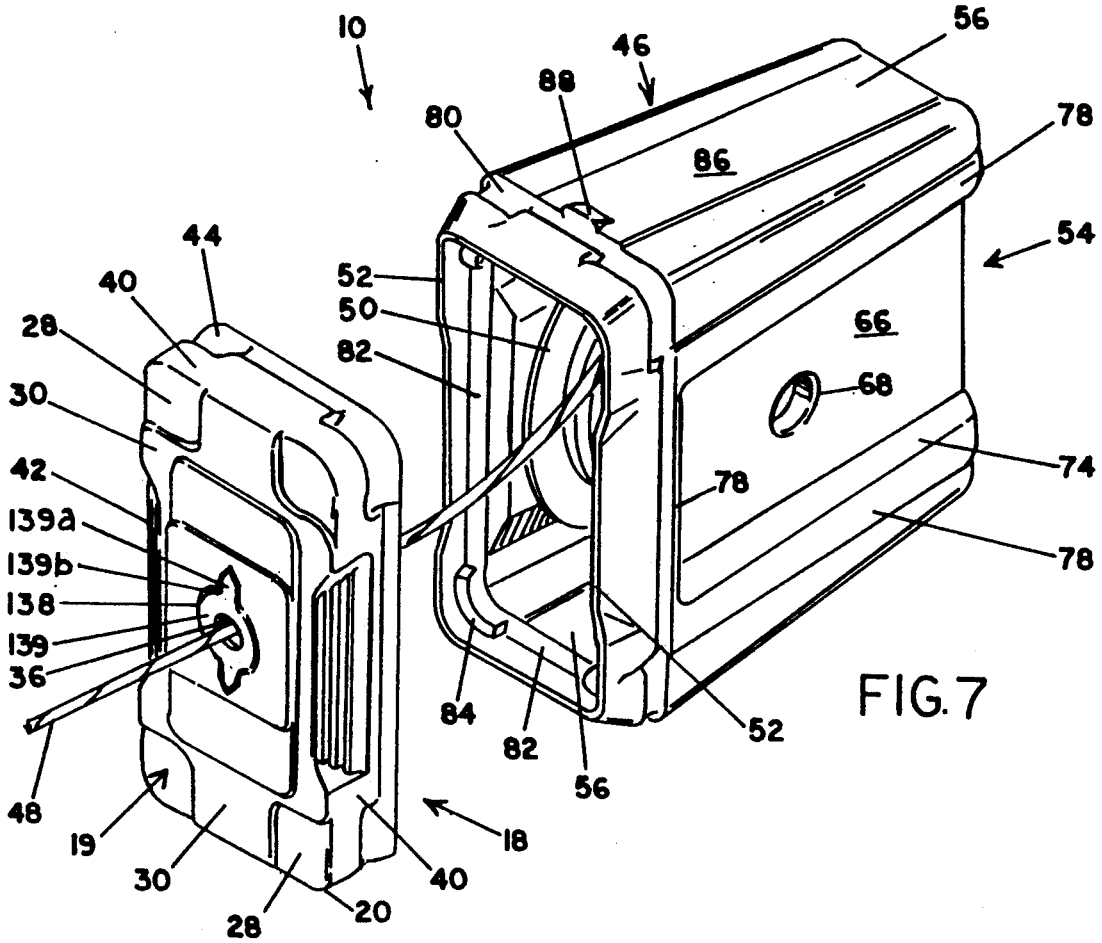
FIG. 7 is a perspective view of the container of FIG. 5 with the lid removed therefrom and showing the cable mounted therein and exiting through the lid.
Figure 8:
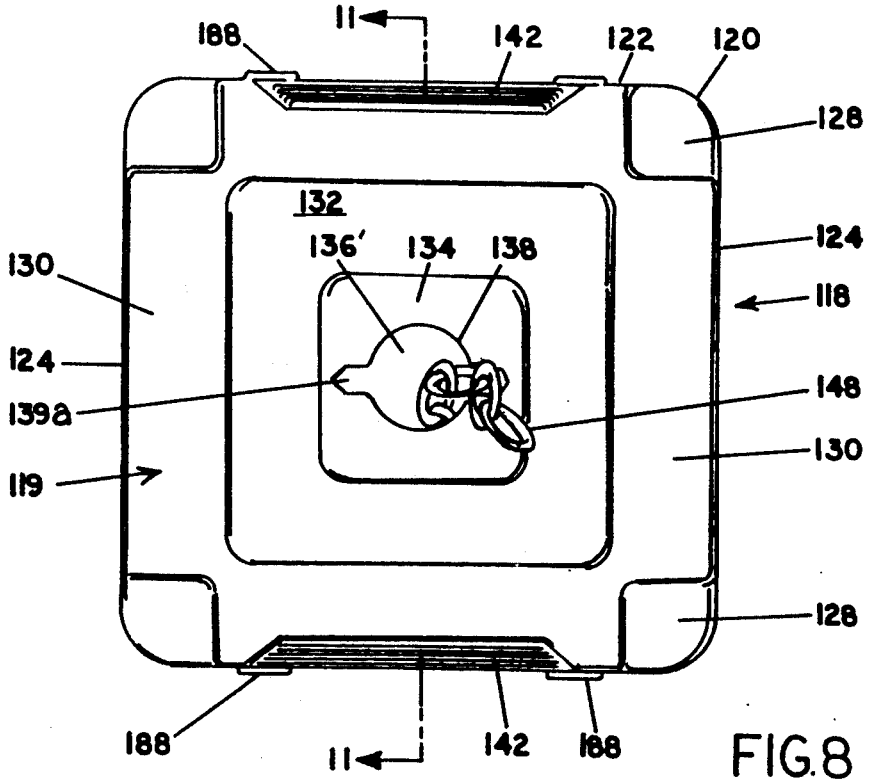
FIG. 8 is a front elevational view of a second embodiment of a chain storage and dispensing container constructed in accordance with and embodying the present invention.

Flat wall portion 78 extends transversely toward and flows into corresponding corner portions 62 preferably coextensively therewith, terminating in the direction of edge 52 at an elongated groove-like indentation 80 which is formed preferably continuously entirely around box 46, approximately one inch rearward from open edge 52. Indentation 80 acts as a detent for inwardly turned lip 44 of lid 18. FIG. 7 shows that on the inside of box 46 indentation 80 preferably forms a ledge 82 continuously around and inward of edge 52, and is reinforced at the inside corners 62 with curved block portions 84.

Opposed side walls 56 of box 46 preferably include rectangular flat central areas 86 which extend from rear wall 58 toward edge 52 but terminate outwardly at indentation 80. Preferably at each intersection of each flat portion 86 and indentation 80 on walls 56 there are formed outwardly extending integral tabs 88 positioned transversely centrally on walls 56. FIG. 1 and FIG. 3 illustrate a guide tab 88 of a box 46 positioned in a groove 16 of shelf 12 to deter lateral movement of container 10 thereon. Alternatively, tabs 88 can be provided on flange 40 of lid 18 centrally in relation to edges 24.

FIGS. 8 through 12 illustrate a second embodiment of the present invention generally designated 100 and which, like container 10, may be used on conventional retail store shelves, but is especially well suited for use with the previously mentioned new chain merchandising apparatus. Container 100 is very similar to container 10, but is larger, having four walls having dimensions substantially the same as those of wall 54 of container 10. Thus container 100 is generally square in cross-section and has approximately twice the volume of container 10 so as to be suitable for storing and dispensing larger types of chain. Container 100 is particularly well suited for holding and dispensing very heavy chain, such as that shown in FIGS. 8 and 11 and designated 148 or, alternatively for use with larger reels (not shown) of wire, cable and the like.

Container 100 includes a snugly fitted lid 118 and a box or holder portion 146. Lid 118 includes rounded corners 120 connected by first opposed parallel side edges 122 and second opposed, parallel side edges 124. Lid 118 is substantially square in general area and has a plateaued, multiplanar face 119, similar to that described in regard to the previous embodiment. Inward of corners 120 are flat formed areas 128 which all lie in the same plane. Flat corner portions 128 are connected by a raised irregularly shaped planar area 130 which is centrally connected to a next adjacent outwardly raised flat area 132. Raised area 132 is square and has located centrally thereon a smaller raised, flat, substantially square area 134 which is centrally penetrated by an aperture 136 for access to chain such as that indicated at 148 stored in container 100.

Similarily to aperture 36 of the first embodiment, an aperture (not shown) is preferably initially circular and approximately one-half inch in diameter and is surrounded by a line of weakness 138 which defines an area which when removed leaves aperture 136' with a more or less key-hole or donut shape having at least one pointed extension 139a thereon. As with container 10, here the removed lid area is connected to square planar area 134 by spaced, formed connector portions (not shown). In use, it is a simple matter to pry or pop out the donut-shaped portion with, for example, a conventional screwdriver. Thereafter, an end of chain 148 may be pulled outward through the enlarged aperture 136' and removably lodged in a pointed extension 139a as desired, so as to prevent inadvertent slippage of chain 148 back into container box portion 146.

Although in each embodiment the described line of weakness 138 is formed to define an opening only large enough for passage therethrough of a finger or two, if desired, it could of course be sized large enough to permit entrance of an entire hand or several fingers through the corresponding opening of a container 10, 100. As illustrated with only two opposed pointed extensions 139a, each half of lid 118 is identical to the other half (either vertical or horizontal) so that lid 118 may be rotated in a plane of face 119 by 90° in either direction and continue to function satisfactorily. If relatively small chain is stored in container 100 it may be preferred to position lid 118 such that the longitudinal axis of a pointed extension 139a of aperture 136' is vertical, for more sure retention of a link of chain thereby. Also, although only two opposed pointed extensions 139a as shown, it is conceivable that four such pointed extensions 139a may be formed in opposed pairs so that in placing a filled container 100 on shelf 12 it is not necessary to give any thought to whether extensions 139a should be placed vertically or horizontally. Rather, the position of container 100 may be determined simply by the position of any printed matter optionally provided on any of the multiple flat surfaces of lid 118 face 119. The same of course applies to the previous embodiment. Alternatively, an odd number of pointed extensions 39a or 139a may be formed in lid 18, 118, respectively.

For convenience of the retailer, an attachment such as a conventional wire twist tie (not shown) may be connected to an end link of chain 148 (or cable 48), threaded out through aperture 136 and secured, for example by tape, to lid 118 at the point of manufacture. Thereafter, upon receipt of filled container 100 by the retailer, it is a simple matter to pop out the donut portion and release the tapered end of chain 148 from lid 118 and pull a length of chain 148 through the enlarged aperture 136' for access by the consumer.

Figure 9:
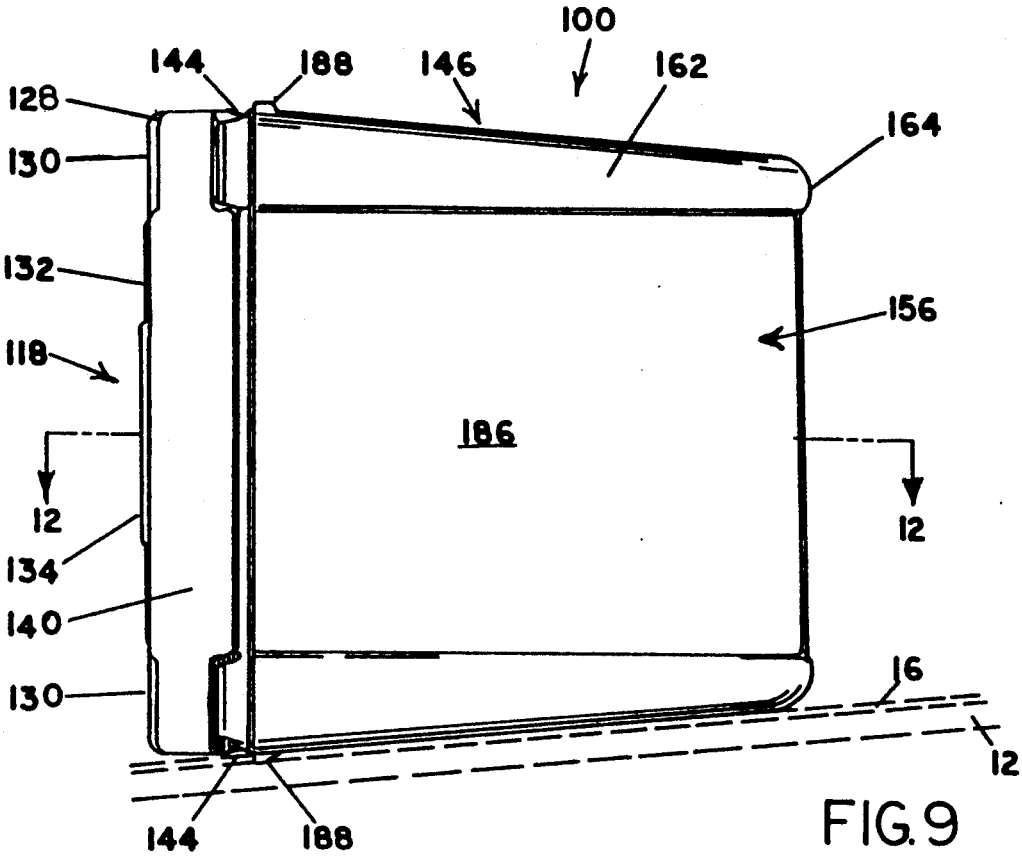
FIG. 9 is a side elevational view thereof without the chain.
Figure 10:
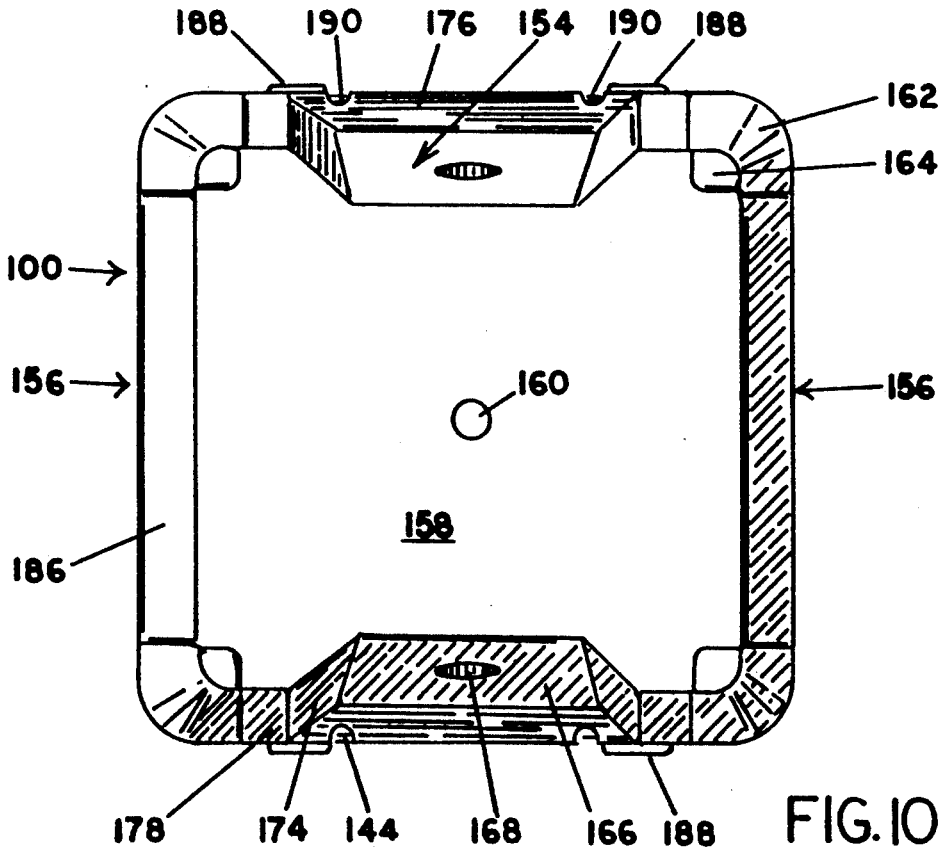
FIG. 10 is a back elevational view of the container of FIG. 8.

FIG. 9 illustrates that lid 118 is provided with a flange 140 which projects perpendicular to the face 119 of lid 118 continuously along all edges 122, 124 and corners 120. Flange 140 terminates in indented lip or edge 144 for interlocking connection with box 146 as later described. Parallel stepped ridges 142 extend along edges 122 from indented lip 144 to irregular flat portion 130 for facilitating gripping and handling of container 100.

Figure 11:
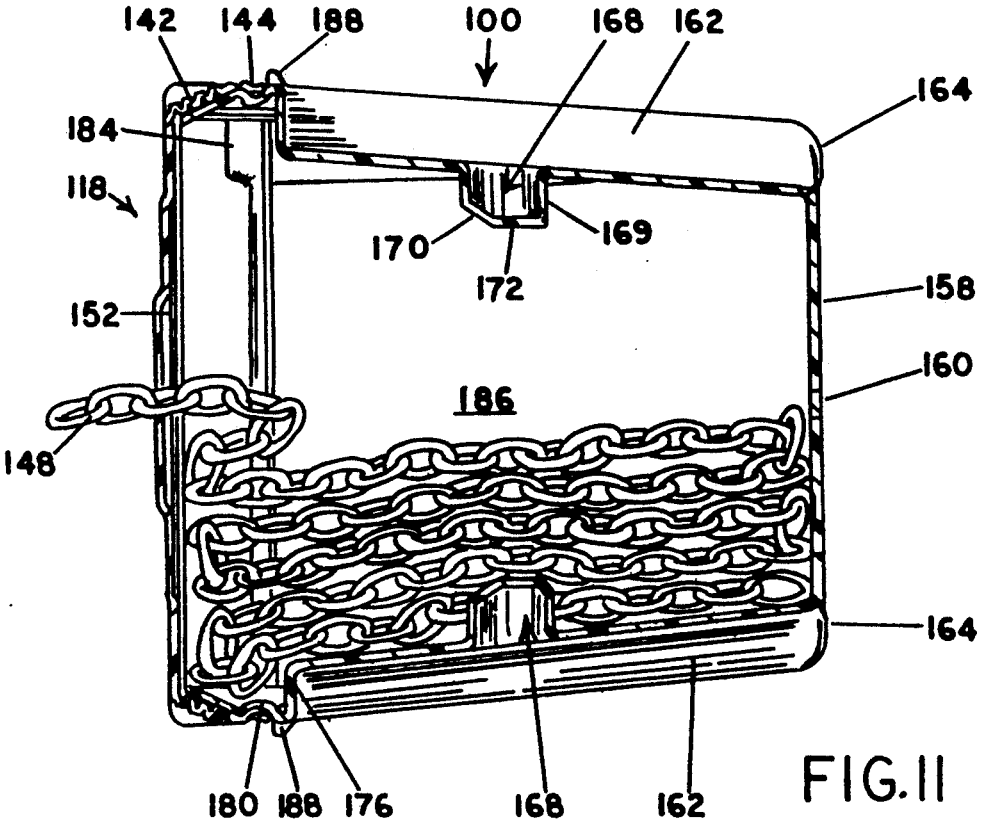
FIG. 11 is a vertical sectional view taken on line 11—11 of FIG. 8.
Figure 12:
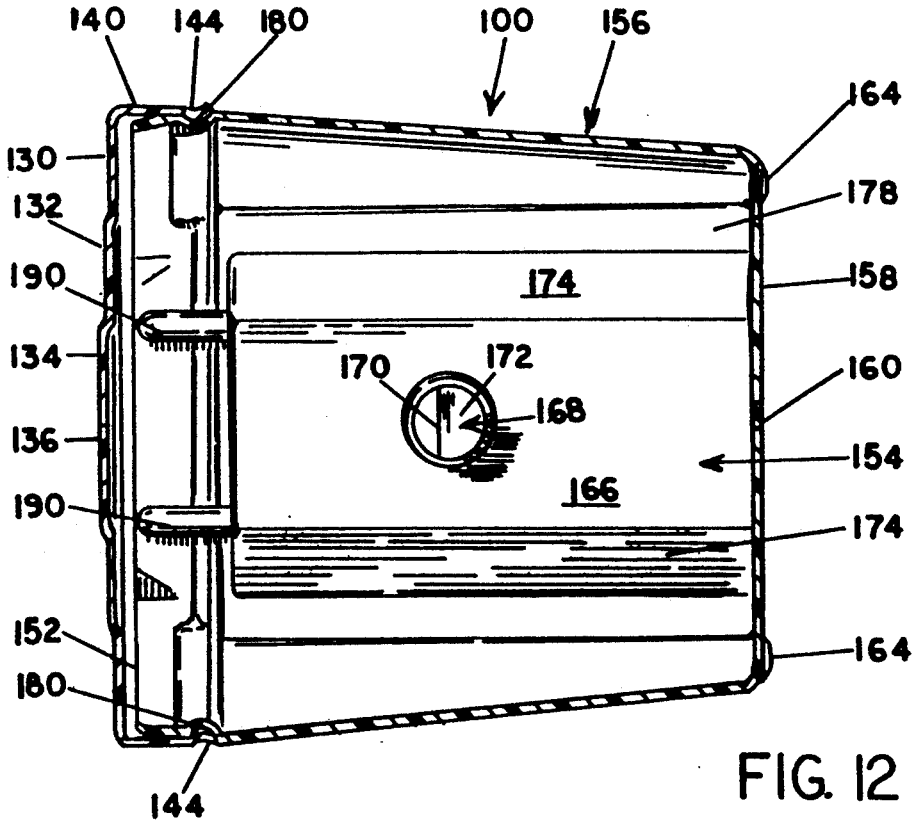
FIG. 12 is a horizontal sectional view taken on line 12—12 of FIG. 9.

FIGS. 11 and 12 illustrate that box 146 extends from a continuous open edge 152 along first opposed paired walls 154 and second opposed paired walls 156 at a slight angle (approximately 5°) inward toward the central longitudinal axis of container 100 to intersect and flow into flat bottom wall 158. Bottom wall 158 is desirably centrally penetrated by a drainage hole 160 (FIG. 10), as in the previous embodiment.

With reference to FIGS. 9 through 12, each wall 154 has a substantially rectangular flat central portion 166 in longitudinal relationship to one wall 154 and provided approximately centrally thereon with an indented hub 168 having a preferably straight-sided annular side wall 169 extending into box 146 and which intersects and continues into an angled flat forward area 170 and a flat rearward area 172, which latter is substantially parallel to flat central portion 166 of wall 154.

FIG. 11 shows that angled portion 170 of indented hub 168 is formed so as to slant from a position substantially adjacent to the inside of side walls 154 toward a central longitudinal axis of box 146 so as to facilitate slideable insertion of a reel (not shown) into box 146. By contrast, flat portions 172 of opposed hubs 168 extend rearwardly parallel to each other, toward bottom wall 158 from angled portion 170 and stop abruptly in corresponding straight-sided annular wall 169 so as to catch a hub of a reel (not shown but similar to that described in regard to the previous embodiment) and to prevent inadvertent removal thereof from box 146. If a reel of particularly heavy chain or other matter is provided within box 146, if desired, a pipe or other elongated rod-shaped item (not shown) may be used to puncture indented hubs 168 and be passed through the reel (not shown) to assist in support thereof within container 146.

If a reel of chain or heavy cable is to be used in container 100 it is preferred to rotate container 100 longitudinally by 90° so that if such a pipe were passed through hubs 168 the pipe would be horizontal rather than vertical. In that case, tabs 188, described hereafter, would not be used. Alternatively, hubs 168 can be provided on side walls 156 rather than 154.

Flat areas 166 of container walls 154 are each longitudinally flanked by two outwardly angled strip-shaped wall areas 174. Strips 174 extend substantially parallel to each other from rear wall 158 in the direction of box edge 152, but terminate at and intersect opposed ends of a ledge 176 which projects transversely and perpendicularly in relationship to flat wall portion 166, parallel to edge 146 so as to be useful as a handle in movement of container 100.

Outwardly angled strips 174 extend transversely and flow into flat wall portions 178 which lie in a plane substantially parallel to flat area 166 of wall 154. Flat wall portions 178 extend transversely and flow into corresponding corner portions 162 preferably longitudinally coextensively therewith, and terminate in the direction of edge 152 at an elongated groove-like indentation 180 which is preferably formed continuously entirely around box 146, approximately one inch rearwardly from edge 152.

Indentation 180 acts as a detent for inwardly turned lip 144 of lid 118. FIG. 11 shows that on the inside of box 146 indentation 180 preferably forms a ledge 182 continuously around and inward of edge 152, and is reinforced at the inside of corners 162 with curved block portions 184.

Preferably at the intersection of each flat portion 166 and a corresponding portion of indentation 180 there are formed outwardly extending integral tabs 188 transversely and centrally on walls 154. FIG. 1 schematically illustrates two boxes 100 with guide tabs 188 positioned in groove 16 of a shelf 12 to deter lateral movement of containers 100 thereon. Alternatively, tabs 188 could be provided on flanges 40 of lids 118 centrally in relation to corresponding edges 122. In either case, tabs 88, 188 serve to facilitate alignment of containers attached thereto, but are not so pronounced as to interfere with stability of the associated containers if same are placed in reclined dispensing position on a shelf lacking guide grooves 16.

Walls 156 of box 146 preferably include rectangular flat central areas 186 which extend from rear wall 158 toward edge 152 but terminate outwardly at indentation 180. In contrast to container 10, in this embodiment, walls 156 are preferably plain, but may alternatively, also have guide tabs such as 188 formed thereon.

FIG. 12 illustrates that perpendicular to and adjacent to edge 152 on side walls 154 are preferably formed paired parallel grooves 190 which cut into ledge 176 at the ends thereof and facilitate the blow molding process for forming tabs 188. Grooves 190 may also be used to assist in popping lid 118 off box 146 if necessary, as by sliding a finger, a screwdriver, or other elongated object under flange 140 and prying upwardly thereon. Ordinarily, however, lid 118 may be separated from box 146 by simply gripping indented lip 144 of flange 140 adjacent to a corner 20 and pulling sharply with one hand while stabilizing the associated chain holder portion with the other hand or arm. A similar lid removal procedure may be applied to container 10.

Containers 10 and 100 are in many respects both used similarily, as is obvious and previously described. FIG. 1 illustrates the convenience of providing the new chain storage and dispensing containers in two preselected sizes, particularly if displayed on the new chain merchandising and display apparatus previously mentioned. If parallel grooves 16 are identically formed and equally spaced on all shelves 12, it is a simple matter to arrange the containers thereon with one container 100 over two parallel grooves 16 or one container 10 over a single groove 16. Thus, one container 100 may replace two containers 10 on a given shelf as is necessary, depending on the items selected for merchandising. So, a wide variety of combinations or arrangements of containers 10, 100 is available, as desired.

As an example of convenient sizes, container 10 may be approximately 11 and ¼th inches deep with side walls extending between a lid of 11 and ⅞th inches by 5 and ¾th inches overall and a bottom of about 4 inches by 9 and ¾th inches overall. Container 100 would preferably vary only by being twice as wide as the narrower of the side walls of container 10. So sized, with the various grooves and indentations described, container 100 will hold the same amount of chain as a conventional five gallon bucket while requiring a much smaller amount of display space. Thus, the new chain storage and dispensing container provides a device for storage, shipping and merchandising of a maximum amount of chain in a minimum amount of space, which in turn reduces costs of shipping and merchandising. As has been clearly shown, the new chain storage and dispensing container offers a number of improvements over the prior art and is completely revolutionary in the field of retail chain merchandising.

It is understood that the various sizes, angles, planes and shapes of the new container shown and described herein are preferred for appearance and strength, but that variations thereof are conceivable that will not interfere substantially with realizing the above objects.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A unitary container for storing and dispensing continuous lengths of chain;

said container comprising a box-shaped chain holder portion having a continuous open top edge adapted for receipt of a selectively removable lid, a bottom wall, and first and second pairs of opposed side walls which extend between and connect said open top edge and said bottom wall, a one-piece lid, means for connecting said lid for secure yet selectively easily removable attachment to said continuous open top edge of said chain holder portion, said lid having integral chain dispensing and retaining means for permitting access to and removal from said chain holder portion through said lid of desired lengths of chain, said integral chain dispensing and retaining means being formed so as to permit effecting snug engagement of an adjacent portion of chain therewith for preventing chain removed from said chain holder portion from unintentionally returning completely thereinto.

2. The container of claim 1, wherein said integral chain dispensing and retaining means is located on a face of said lid and comprises an integral punched portion of said lid having a generally keyhole shape with a central aperture therethrough and at least one pointed extension thereon and is connected along the periphery thereof to said lid by integral connector portions to thereby provide integral chain dispensing and retaining means of a form which may be modified from an aperture shape to a keyhole shape by fast simple, removal of said integral punched portion of said lid and to provide means for dispensing the chain while permitting effecting snug engagement of an adjacent portion of chain therewith for preventing chain removed from said chain holder portion from unintentionally returning completely thereinto.

3. The container of claim 1, wherein the said bottom wall is provided with outwardly extending feet and said lid has an outward facing surface with integral foot rests at locations corresponding to said feet provided on said bottom wall, to thereby enhance upright stacking of a plurality of said containers for storage and shipping.

4. The container of claim 1, and further comprising paired opposed indented integral hubs formed on the side walls of at least one of said first and second pairs of opposed side walls for retention on said hubs of a spool having chain wound thereon within said container.

5. The container of claim 1, wherein said first and second pairs of opposed side walls are inwardly and downwardly sloping, to thereby permit the lid of said container to be presented vertically outward when said container is displayed in reclined dispensing position upon a shelving unit having downwardly and forwardly sloping shelves.

6. The container of claim 1, wherein at least one of said first and second pairs of opposed side walls is provided with integral outwardly extending guide tabs substantially adjacent to said continuously open top edge for placement of said guide tabs within parallel grooves formed from front to back on the shelf of the display unit to thereby deter lateral movement of said container on the shelf.

7. The container of claim 1, and further comprising integral handles formed adjacent to said continuous open edge on at least one of said first and second pairs of opposed side walls.

8. The container of claim 1, wherein said means for connecting includes said container being formed in such manner that said chain holder portion and said lid have an interlocking fit therebetween of such strength as to prevent accidental opening of said container in shipment thereof while still being selectively openable without the use of tools.

9. The container of claim 8, wherein said container is formed of recycled, recyclable plastic.

10. The container of claim 1, wherein said container is rectangular in cross section.

11. The container of claim 1, wherein said bottom wall is substantially flat and defines a through hole to thereby prevent accumulation of liquid in said container when said container is in upright, standing position whereby to deter rusting of chain in said container and to decrease the risk of accidental drowning of small children and pets in said container.

12. In an apparatus for merchandising chain, the combination of, a support structure having shelves and being of sufficient strength and dimensions to support containers of chain, and at least one unitary chain container having chain therein, said chain container comprising a box-shaped chain holder portion having a continuous open top edge adapted for receipt of a selectively removable lid, a bottom wall, and first and second pairs of opposed side walls which extend between sand connect said open top edge and said bottom wall, a one-piece lid means for connecting said lid for secure yet selectively easily removable attachment to said continuous open top edge of said chain holder portion, said lid having integral chain dispensing and retaining means for permitting access to and removal from said chain holder portion through said lid of desired lengths of chain, said integral chain dispensing and retaining means being formed so as to permit effecting snug engagement of an adjacent portion of chain therewith for preventing chain removed from said chain holder portion from unintentionally returning completely thereinto.

13. The combination of claim 12, wherein said integral chain dispensing and retaining means is located centrally on said lid and comprises an integral punched portion of said lid having a generally keyhole shape with a central aperture therethrough and at least one pointed extension thereon and is connected along the periphery thereof to said lid by integral connector portions to thereby provide integral chain dispensing and retaining means of a form which may be modified from an aperture shape to a keyhole shape by fast simple, removal of said integral punched portion of said lid and to provide means for dispensing the chain while permitting effecting snug engagement of an adjacent portion of chain therewith for preventing chain removed from said chain holder portion from unintentionally returning completely thereinto.

14. The combination of claim 12, wherein the shelves of said support structure positioned so as to be downwardly and forwardly sloping, and further wherein said first and second pairs of opposed side walls are inwardly and downwardly sloping, to thereby permit the lid of said container to be presented vertically outward when said container is displayed in reclined dispensing position upon a shelving unit having downwardly and forwardly sloping shelves.

15. The combination of claim 12, wherein the shelves of said support structure have a plurality of parallel grooves formed from front to back thereon, and further wherein at least one of said first and second pairs of opposed side walls is provided with integral outwardly extending guide tabs substantially adjacent to said continuously open top edge for placement of said guide tabs within parallel grooves formed from front to back on the shelf of the display unit to thereby deter lateral movement of said container on the shelf.

16. The container of claim 1, wherein the walls of said first pair of opposed side walls extend between and intersect the walls of said second pair of opposed side walls in such manner as to form smooth rounded corners on said container extending from said bottom wall to said continuous open top edge, and further wherein said one-piece lid includes smooth, rounded corners corresponding to the smooth rounded corners of said chain holder portion.

17. The container of claim 9, wherein the plastic of said container is of a type suitable for blow molding.

18. The container of claim 7, wherein said one-piece lid further comprises parallel stepped ridges formed along and parallel to opposed sides of said lid for positioning parallel to said corresponding integral handles when said lid is placed upon said container to facilitate gripping and handling thereof.

19. The container of claim 2, wherein said integral punched portion is located centrally on said lid.

20. The container of claim 4, wherein each of the hubs of said paired integral indented hubs includes a straight-sided annular wall which extends into said chain container and intersects and continues into a slanted portion which angles from a position substantially adjacent the inside of the associated side wall toward a central longitudinal axis of said container so as to facilitate slidable insertion of a chain containing reel into said chain container and onto said hubs for rotatable mounting thereon while preventing inadvertent removal of the reel from said container.

21. The container of claim 1, wherein said container is reusable and said one-piece lid is replaceable and said means for connecting includes an integral flange extending from and contiguous with the perimeter thereof and terminating in a continuous lip which is indented at least partially along its length and further wherein the continuous open top edge of said chain holder portion includes an elongated groove-like indentation formed continuously therearound for acting as a detent for said inwardly turned lip of said one-piece lid to thereby provide a secure interlocking fit between said one-piece lid and said chain holder portion.

* * * * *